United States Patent [19]

Akers

[11] 4,095,065

[45] June 13, 1978

[54] SAFETY TRIP MECHANISM FOR MULTI-POSITION SWITCH

[75] Inventor: Donald J. Akers, Chicago, Ill.

[73] Assignee: G & W Electric Specialty Company, Blue Island, Ill.

[21] Appl. No.: 777,936

[22] Filed: Mar. 15, 1977

[51] Int. Cl.[2] ..... H01H 19/32

[52] U.S. Cl. ..... 200/63 R; 74/97

[58] Field of Search ..... 200/63 R, 65, 66, 153 SC, 200/155 R, 154; 74/97, 112

[56] References Cited

U.S. PATENT DOCUMENTS

| | | | |
|---|---|---|---|
| 1,590,555 | 6/1926 | Smisor | 200/45 |
| 3,260,808 | 7/1966 | Dimond et al. | 200/42 T |
| 3,330,919 | 7/1967 | Kovats | 200/42 R |
| 3,403,565 | 10/1968 | Kovats | 200/63 R |
| 3,858,133 | 12/1974 | Swanson et al. | 200/63 R |
| 3,919,512 | 11/1975 | Ray et al. | 74/97 |

*Primary Examiner*—Richard C. Queisser
*Assistant Examiner*—Stephen A. Kreitman
*Attorney, Agent, or Firm*—Fitch, Even, Tabin & Luedeka

[57] ABSTRACT

A high voltage multi-position switch is disclosed having stored energy and safety trip mechanism associated therewith to facilitate remote control of quick-make and quick-break switch contact operation whereby to provide operator protection during load interruption and close into fault operation of the switch.

7 Claims, 3 Drawing Figures

SAFETY TRIP MECHANISM FOR MULTI-POSITION SWITCH

The present invention relates generally to high voltage switchgear, and more particularly to high voltage multi-position load interrupting switches having provision for quick-make, quick-break switching to obtain both load interruption and close into fault operation, and including novel stored energy and safety trip mechanism operatively associated with the multi-position switch to facilitate remote control and tripping of the operator mechanism after charging to a stored energy condition.

In the operation of high voltage electric switches capable of controlled snap action movement between various positions for performing switching operations, the safety of the operator or switchman is of paramount importance. Once the switchman has placed the switch in a charged or energy storing condition preparatory to performing a switching operation, the mechanical operator takes over and completes the actual current break or make at a controlled rate of speed independent of operating action on the part of the switchman. In addition, once the mechanical switch operator takes over the switching operation, the switchman cannot slow down, stop or reverse the action.

Examples of high voltage multi-position switches which employ energy storing means for effecting snap-action movement of switch contacts to obtain both load interruption and close into fault operation are disclosed in U.S. Pat. Nos. 3,177,732, 3,330,919 and 3,403,565, all of which are assigned to the assignee of the present invention. While such switches are designed with adequate margin for normal operation, factors such as improperly installed cable terminations and/or defective cable or improper connections may be encountered which increase the current across the switch contacts as they are opened on a fault in excess of the load interrupting rating thereby creating the potential for possible injury to an operator located close to the switchgear. For example, in oil switches, if a fault exists between two phases of a three-phase connection to the switch box or one phase is faulted to ground and a switch function is effected which opens the switch and thereby opens the fault, arcing may occur which cannot be extinguished and which is sufficient to create substantial gas pressure within the confined oil switch box which may tend to fracture the switch casing with possible serious injurious results. With such potential for danger to an operator or switchman, it is highly desirable that the switchman be able to effect a switching function remotely from the switchgear so that if the aforenoted problems occur, the switchman will not be injured.

One of the primary objects of the present invention is to substantially eliminate the aforenoted potential dangers in the operation of snap-action multi-position high voltage switches through the provision of novel stored energy mechanism means which includes safety trip means facilitating remote tripping of such switches without endangering the switchman.

A more particular object of the present invention is to provide stored energy mechanism for use with a high voltage multi-position switch having movable contacts adapted to be moved through a snap action movement between various switch positions by the release of potential energy created by energy storage means in the form of arming springs, the stored energy mechanism including a safety trip having a latch plate rotatable with the movable contacts and a latch lever operatively associated with the latch plate in a manner to prevent unintentional actuation thereof but facilitating remote control to release the latch plate and movable contacts for effecting a switching operation.

Further objects and advantages of the present invention, together with the organization and manner of operation thereof, will become apparent from the following detailed description of the invention when taken in connection with the accompanying drawings wherein like reference numerals designate like elements throughout the several views, and wherein.

Figure 1:
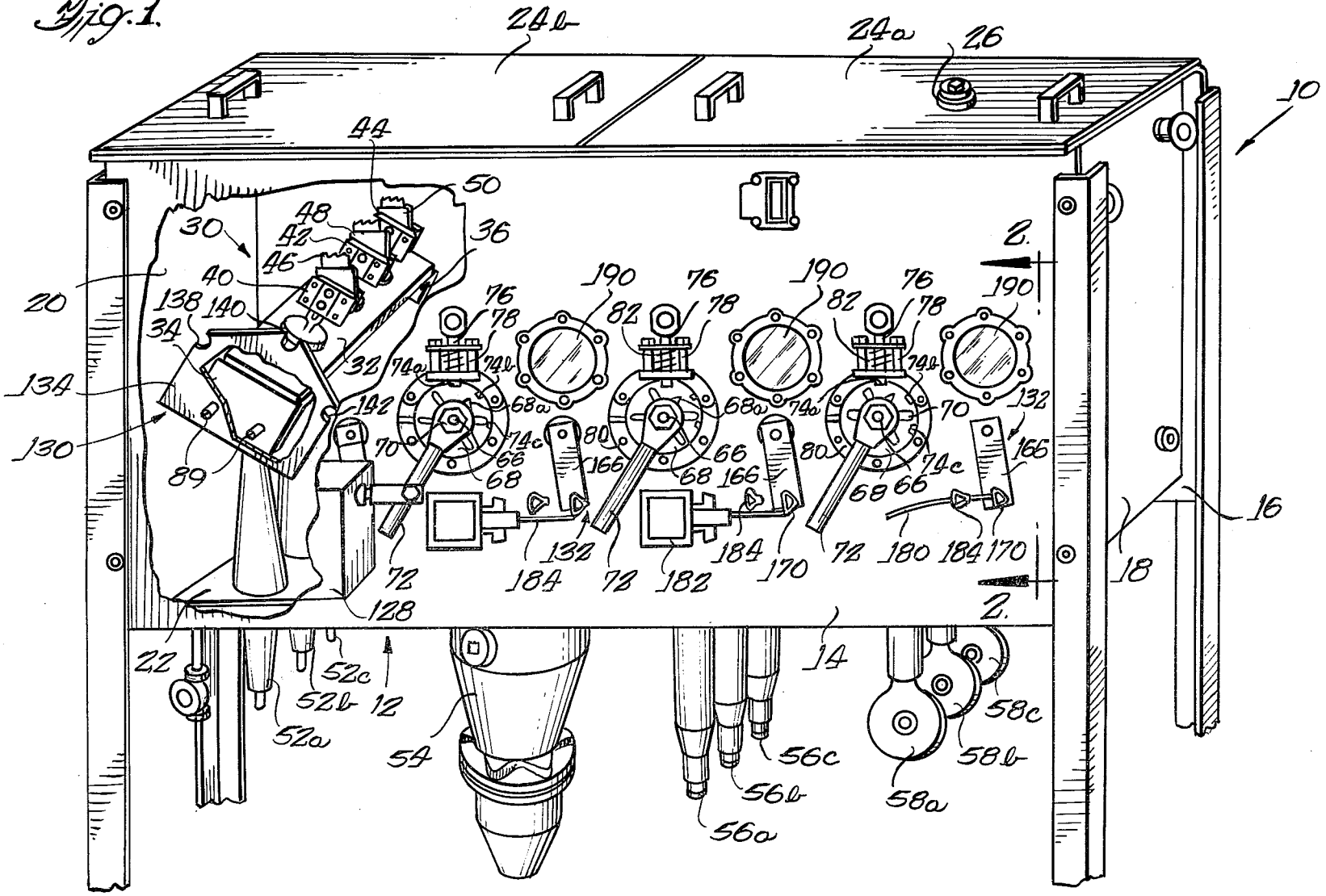
FIG. 1 is a perspective view of a high voltage switchgear assembly incorporating the present invention, portions being broken away to illustrate some of the internal components.

Referring now to the drawings, and in particular to FIG. 1, the present invention is illustrated, by way of example, in associated relation with high voltage switch means, indicated generally at 10. The high voltage switch means 10 takes the form of a four way oil switch having a generally rectangular shaped fluid tight casing indicated generally at 12. The casing 12 includes parallel vertical front and rear walls 14 and 16, respectively, connected through end walls 18 and 20. A base plate 22 is sealingly secured at its peripheral edges to the front, back and end walls. Removable top cover plates **24*a* and 24*b* establish the top of the casing 12, the top plate 24*a* having a plugged oil fill boss 26 suitably formed thereon to facilitate filling of the casing 12** with an oil having suitable dielectric properties, as is known.

In the illustrated high voltage switch 10, four sets or banks of movable switch contacts, alternatively termed movable switch contact assemblies, are supported internally of the casing 12, one such bank of switch contacts being indicated generally at 30. The switch contact assembly 30 is adapted for three position movement and includes a horizontally disposed rotatable switch contact support arm 32 having inverted L-shaped trunnion support brackets 34 and 36 secured to its opposite ends. The rear trunnion support bracket 36 is pivotally supported on a stub shaft (not shown) secured to the rear wall 16 in a normal relation thereto. The front trunnion support bracket 34 is secured to switch mechanism to be described more fully hereinbelow. The switch contact support arm 32 supports three sets of movable switch contacts 40, 42 and 44 associated insulators for movement between "closed", "open" and "ground" positions as is known. In the illustrated embodiment, the contacts 40, 42 and 44 are shown in "closed" positions engaging fixed switch contacts 46, 48 and 50, respectively.

The casing 12 supports a service entrance for each internal switch contact assembly. In the illustrated embodiment, bushing type entrance connection is provided at **52*a–c*, a paper lead with wiper type entrance is shown at 54, taped type entrance connection is provided at 56*a–c*, and universal type entrance connection is provided at 58*a–c***. The various service entrance connectors are of known design and, per se, do not form a part of the present invention.

Figure 3:
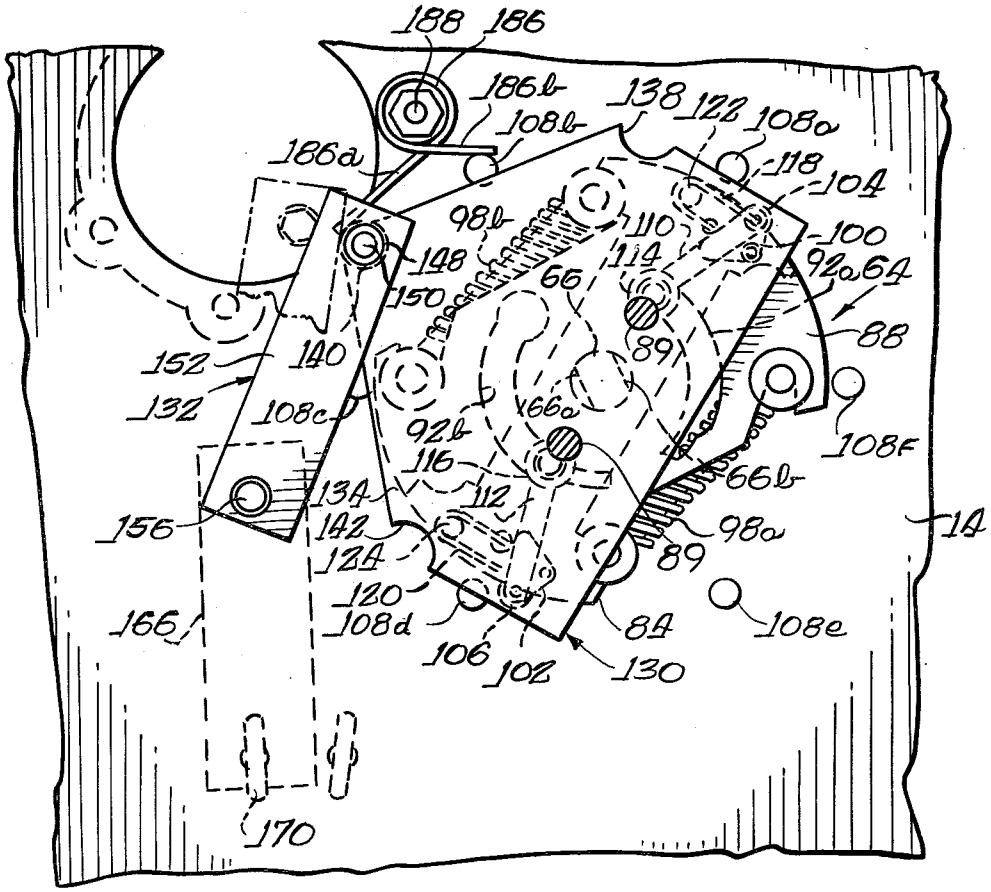
FIG. 3 is a partial sectional view taken substantially along the line 3—3 of FIG. 2, looking in the direction of the arrows, with the movable contact assembly removed and with the various components of the switch operator mechanism shown in charged positions.
Figure 2:
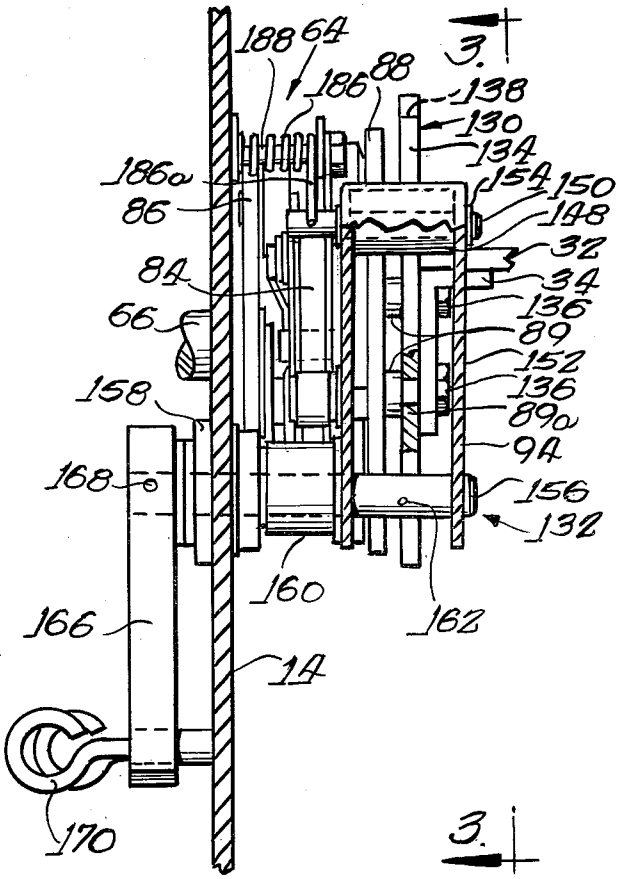
FIG. 2 is an enlarged partial sectional view taken substantially along the line 2—2 of FIG. 1, looking in the direction of the arrows.

With reference to FIGS. 2 and 3, taken with FIG. 1, each contact support arm 32 has connection with a switch operator mechanism, one of which is indicated generally at 64 in FIGS. 2 and 3. In the illustrated embodiment, the switch operator mechanism 64 is generally similar to the spring energized switch operator disclosed in U.S. Pat. No. 3,403,565 to W. S. Kovats, dated Oct. 1, 1968, which is incorporated herein by reference. The switch operator mechanism 64 differs from that in the aforenoted Kovats patent in that it is modified for stored energy operation.

Each switch operator mechanism 64 includes an arming shaft 66 which extends through the front wall 14 of casing 12 and is axially aligned with the pivot axis of the associated support arm 32. Each arming shaft 66 has a circular locking plate 68 fixedly secured thereon, as shown in FIG. 1, for rotation therewith and has a hexagonal nut 70 supported on and fitting with "flats" on shaft 66 so that rotation of nut 70 effects a corresponding rotation of plate 66. An arming handle 72 is removably mountable on each nut 70 and is adapted to rotate the corresponding arming shaft 66 so as to facilitate selective arming of the switch operator mechanisms as will become more apparent hereinbelow.

Each locking plate 68 has radial slots or detents as at 74*a*, 74*b* and 74*c* formed in its peripheral edge surface adapted to receive the inner end of a radially positioned locking pin 76 supported for radial sliding movement by a support bracket 78. Each bracket 78 is supported by a retainer ring 80 secured to the outer surface of the front wall 14 of casing 12 by a plurality of screws. A coil spring 82 is disposed about each locking pin 76 and biases it into the slot 74*a*, 74*b* or 74*c* positioned to receive the locking pin, the locking pin being releasable to allow rotation of the associated locking plate 68 during arming. Each locking plate 68 preferably has an indicator arrow 68*a* thereon to provide an indication of the position of the locking plate relative to "to closed", "to open" and "to ground" indicia as may be provided on the outer surface of the retaining ring 80. In this manner the condition of the arming shaft 66 for each contact support arm 32 within the high voltage switch 10 may be readily observed externally of the casing 12.

The internal components of each switch operator mechanism 64 are described in detail in the aforenoted Kovats Pat. No. 3,403,565. Briefly, each operator mechanism 64 includes a switch actuating plate 84 and a pair of similarly shaped torque plates 86 and 88 located on opposite sides of the actuating plate 84 and parallel thereto. The switch actuating plate 84, which may alternatively be termed a reaction plate, is secured to the forward trunnion support plate 34 through a pair of support rods 89 so as to effect rotation of the movable contact support arm 32 upon snap action movement of the reaction plate 84 as will become more apparent below.

The torque plates 86 and 88 have slotted central openings therethrough for cooperation with flats 66*a* and 66*b* (FIG. 3) formed on the inner end of the arming shaft 66 so that the torque plates are rotated about the axis of the arming shaft upon rotation of the arming shaft. The reaction plate 84 and the torque plates 86 and 88 are configured to support power or energy storage means therebetween in the form of a pair of arming springs 98*a* and 98*b*. The arming springs 98*a*, *b* normally maintain the switch reaction plate 84 and torque plates 86 and 88 in their relative positions shown in FIG. 6 of the aforereferenced U.S. Pat. No. 3,403,565.

During an arming operation, the torque plates 86 and 88 are rotated through rotation of the associated arming shaft 66 to charge the switch operator mechanism 64 so that it operates in the same rotation as it was charged. To prevent a corresponding rotation of the switch reaction plate 84 as the torque plates 86 and 88 are rotated to load the springs 98*a*, *b*, holding and release elements in the form of pairs of latch plates 100 and 102 are pivotally carried on the reaction plate 84 and each pair of latch plates rotatably supports a roller 104 and 106, resepectively. The rollers 104 and 106 are cooperable with stops 108*a*–108*f* fixed to the inner surface of the front wall 14 of casing 12 in normal relation thereto and equidistantly spaced about a common circle concentric with the axis of arming shaft 66. In the illustrated embodiment, six stops 108*a*–*f* are provided at 60° angular increments about their common center circle. Levers 110 and 112 are carried by the switch reaction plate 84 in cooperating relation with the pairs of latch plates 100 and 102, respectively. The levers 110 and 112 have spool guides 114 and 116, respectively, rotatably carried on their inner ends and received within slots 92*a* and 92*b*, respectively, in the torque plate 88. torsion springs 118 and 120 are supported on pins 122 and 124, respectively, secured to the reaction plate 84 such that the torsion springs bias the rollers 104 and 106 generally radially outwardly from the axis of rotation of the reaction plate.

In the operation of the switch operator mechanism 64 thus far described, cocking of the mechanism is effected by rotating the arming shaft 66 through the arming handle 72 so as to arm the coil springs 98*a*, *b*. Movement of the arming handle 72 may be accomplished manually or remotely by means of a motorized arming mechanism of known design, such as indicated at 128 in FIG. 1. The outwardly biased rollers 104 and 106 are cooperative with the various stops 108*a*–*f* to prevent rotation of the reaction plate 84 during arming of the springs 98*a*, *b* dependent upon the direction of rotation of the arming shaft 66. Assuming the right-hand arming shaft 66 of FIG. 1 has been rotated in a counterclockwise direction to open the associated internal switch contacts, the torque plates 86 and 88 will now be rotated in a clockwise direction to effect a clockwise transfer, as viewed in FIG. 3. During such rotation of the plates 86 and 88, the roller 106 engages the stop 108*d* and prevents a corresponding rotation of the reaction plate 84. It will be understood that during initial charging of the switch operator mechanism, the locking pin 76 is removed from the associated detent 74*a* in the locking plate 68 manually at the site of the switch. After initial removal of the locking pin 76, it is released so as to enter the detent 74*b* when the locking plate 68 has been rotated 60°.

When the torque plates 86 and 88 have been rotated to fully arm and load the springs 98*a*, *b*, the spool guide 116, which rides in the arcuate shaped slot 92*b* in the torque plate 88, is engaged by the end of the slot 92*b* so as to release the roller 106 from stop 108*d* whereafter the reaction plate 84 is freed for rotational advancement in a snap-action movement to effect a quick-break opening of the corresponding movable switch contacts 40, 42 and 44 relative to the associated fixed contacts 46, 48 and 50. As the reaction plate 84 rotationally advances, the roller 106 is again moved outwardly so as to engage the next successive stop 108*c* to prevent further advance of the switch actuating plate and associated contact support arm 32. Simultaneously, the roller 104 will be forcibly rolled under stop 108*f* and will be yieldingly forced outwardly to its normal position after rebound. In this manner, the reaction plate 84 is stopped and locked in position and remains stationary in its advanced position until again activated as aforedescribed.

The switch operator mechanism 64 thus far described is capable of effecting a quick-make or quick-break snapaction switch transfer of the movable switch contacts within the switch casing 12. If a fault should exist in one of the three-phase connections to the switch 10 so that the corresponding movable contacts are attempting to interrupt a fault in excess of the load interrupting rating, arcing may occur of sufficient magnitude to create substantial gas pressure within the confined oil switch box which may result in possible injury to the switchman.

In accordance with the present invention, safety means are operatively associated with each of the multi-position switch operator mechanisms 64 to facilitate remote control and tripping of the operator mechanisms after charging the operator mechanism to stored energy conditions as aforedescribed. To this end, latch plate means, indicated generally at 130, is operatively associated with each switch reaction plate 84 and corresponding switch contact support arm 32 and is cooperable with remotely operable latch lever means, indicated generally at 132, to selectively prevent movement of the latch plate means so as to facilitate control of switch transfer from a location remote from the high voltage switch 10.

Each latch plate means 130 includes a generally planar latch plate 134 which may be made of a suitable metallic plate and which may be secured directly to the associated operator mechanism 64. To this end, each latch plate 134 is adapted to receive the corresponding support rods 89 therethrough in supporting relation. Each latch is held against annular shoulder surfaces, such as indicated at 89*a* in FIG. 2, on its associated support rods by the associated forward trunnion plate 34. Nuts, such as shown at 136 in FIG. 2, are secured on threaded outer end portions of the rods 89 and retain the trunnion plates 34 and latch plates 134 on the respective pairs of support rods 89. In the illustrated embodiment, the latch plate 134 has detent means in the form of three recesses 138, 140 and 142 formed in its peripheral edge, the recesses being generally semi-circular in configuration and having centers lying on a common diameter concentric with the axis of the arming shaft 66. The recesses 138, 140 and 142 are equidistantly spaced on their common diameter at 60° increments about the pivot axis of the rocker arm 32. The recesses 138, 140 and 142 are positioned so as to receive a latch roller 148 therein when the latch plate 134 and associated contact support arm 32 are in predetermined rotational positions relative to the pivot axis of the rocker arm. In the illustrated embodiment, the latch roller 148 is received within the recess 140 in the latch plate 134 when the movable switch contacts 40, 42 and 44 are in open relation with the associated fixed contacts 46, 48 and 50. The recesses 138, 140 and 142 are configured such that when the latch roller 148 is received therein, rotation of the latch plate 134 is prevented.

The latch roller 148 is supported on a support shaft 150 which extends through and is supported within suitable axially aligned openings in a U-shaped latch lever 152, the shaft 150 being maintained in fixed axial relation relative to the latch lever by retaining rings 154. The latch lever 152 may take the form of a bar or other suitable form and is supported on a pivot shaft 156 which extends through a suitable opening in the front casing wall 14 and is supported within such opening by a shaft seal 158so as to prevent leakage through the wall 14 peripherally of the shaft 156. The latch lever 152 is spaced inwardly from the wall 14 by an annular spacer 160. A roll pin 162 fixedly secures the latch lever 152 on the inner end of the pivot shaft 156.

An actuating lever arm 166 is fixedly secured to the end of the pivot pin 156 spaced outwardly from the front wall 14 of casing 12, as through a pin connection 168, such that pivotal movement of the lever arm 166 effects a corresponding pivotal movement of the support shaft 150 and latch roller 148 carried thereon. An eyebolt 170 is fixed to the lower end of the actuating lever arm 166 to facilitate connection of the actuating lever arm 166 to a control rope such as partially indicated at 180 in FIG. 1, or to a remotely controlled actuating solenoid as indicated at 182 in FIG. 1. An eyebolt 184 is secured to the outer surface of the front wall 14 of casing 12 in generally horizontal alignment with each of the eyebolts 170 on the actuating arms 166. The eyebolts 184 provide a guide for the rope 180 so as to insure the desired pivotal movement of the associated actuating arm 166 when an axial force is applied to the rope. The eyebolts 170 and 184 are positioned to facilitate locking of the arms 166 in positions to maintain the latch rollers 148 spaced from the latch plates 134 so as to disable the latch plate means 130 when it is desired that the multi-position switch mechanisms 64 be operated in a non-stored energy mode of operation.

With reference to FIGS. 2 and 3, the latch rollers 148 are biased into engagement with their associated latch plates 134 by torsion springs 186 each of which is suitably supported on a stub shaft 188 secured in normal relation to the front casing wall 14. Each torsion spring 186 includes a first arm portion 186*a*, which engages the associated latch roller support shaft 150, and a second arm portion 186*b* which engages the adjacent stop 108*b*. The torsion springs are coiled about the stub shafts 188 so as to bias the latch rollers 148 into engagement with the recess 138, 140 or 142 disposed in position to receive the latch roller 148.

While the latch plate 134 has been described as having detent means thereon in the form of recesses 138, 140 and 142 which are cooperable with rollers 148 carried by the latch lever 152, the detent means on the latch plate 134 may take the form of short stub shafts secured in normal relation to the plane of the latch plate at locations corresponding to the illustrated recesses 138, 140 and 142. Such stub shafts would be cooperable with a locking recess formed on the latch lever 152 to accomplish the same result as the illustrated embodiment.

It will be understood that the actuating lever arms 166 may be disposed within the casing or tank 12 with suitable controls, such as solenoid trips, associated therewith to facilitate remote control. For example, the lever arms 166 might be mounted within the tank where the switch unit is submerged, or is subject to being submerged in a flood situation. It will also be understood that the biasing springs 186 represent one type of biasing means and that other means may be employed to achieve the intended purpose.

In the operation of the illustrated three position switch assemblies 30, with the movable switch contacts 40, 42 and 44 in either ground, open or closed relation with fixed contacts within the casing 12, the latch plates 134 will each be in a position to receive the associated latch roller 148 in either detent recess 138, 140 or 142 so as to prevent rotation of the latch plate 134 and thus rotation of the associated switch contact support arm 32. During an arming operation, the locking pin 76 associated with the switch operator mechanism 64 undergoing the switch transfer is released from the associated locking plate 68 whereafter the arming handle 72 is moved in the same direction as to arm the mechanism to close, open or ground the movable switch contacts.

Movement of the arming handle 72 in a direction to fully load or arm the springs 98*a, b* effects release of the one of the rollers 104 or 106 which, until full loading, prevented advance of the switch reaction plate 84. Under normal non-stored energy conditions, the reaction plate 84 would move the movable contacts 40, 42 and 44 to either their closed, open or ground positions to complete the switch transfer. However, with the latch plate 134 being locked against rotation by engagement with the latch roller 148, such movement of the actuating plate is prevented. The actuating plate 84 can only undergo the necessary movement to effect a corresponding rotation of the contact support arm 32 when the roller 148 is released from the recess 140 or 142 in which the latch roller is disposed. In this manner, a stored energy mechanism is provided wherein the switchman can arm the switch operator mechanism 64 and effect switch transfer from a station remote from the high voltage switch 10 by remote control of the solenoid 182 or remote pulling of the rope 180 to release the latch roller 148 from the latch plate 134 whereafter the latch plate and switch actuating plate 84 are free to complete the switch transfer. Should the switch attempt to interrupt a fault in excess of the load interrupting rating, any possible adverse results will not cause possible injury to the switchman.

Preferably, viewing windows, such as indicated at 190 in FIG. 1, are provided in the front wall 14 of casing 12 adjacent each of the switch operator mechanisms 64 so as to allow a visual observation or confirmation of the position of the internal switch contacts 40, 42 and 44.

Thus, in accordance with the present invention, a stored energy mechanism for high voltage switches is provided which includes safety trip control facilitating remote control of the release of stored energy within a snap-action mutli-position switch operator mechanism and thereby presents substantial safety advantages to a switchman. The safety latch means in accordance with the invention is relatively economical to manufacture and provides improved safety for the switchman over quick-make, quickbreak high voltage switch operator mechanisms heretofore available. The stored energy mechanism of the present invention may be used in automatic and semi-automatic applications where minimum transfer time is desired.

Although the illustrated switch operator mechanism 64 has been described in connection with three position operation, it will be appreciated that the switch operator mechanism can be operated to effect snap-action transfer through as many as six switch positions during a single revolution of the arming shaft 66, and that correspondingly, the latch plate 134 can be configured to provide a number of detent recesses in its peripheral edge surface as necessary to accomodate the number of transfer positions to which the switch operator mechanism is adapted.

While a preferred embodiment of the present invention has been illustrated and described, it will be understood to those skilled in the art that changes and modifications may be made therein without departing from the invention in its broader aspects. Various features of the invention are defined in the following claims.

What is claimed is:

1. In switchgear which includes a casing, switch contact means disposed within said casing and including at least one pair of switch contacts at least one of which is movable relative to the other between a position spaced from said other in open electrical circuit therewith and a position contacting said other in closed electrical circuit therewith, actuating means for moving said movable switch contact between said spaced and contacting positions relative to said other of said contacts, said actuating means including a movable arming handle, energy storage means operatively associated with said arm handle and said movable switch contact and adapted to create potential energy during movement of said arming handle, said actuating means further including release means operative to release said potential energy and facilitate snap-action movement of said movable switch contact between its said spaced and contacting positions; the combination therewith comprising latch plate means operatively associated with said movable switch contact and movable therewith, said latch plate means having detent means thereon, and latch lever means pivotally supported by said casing and movable between a first position cooperating with said detent means to prevent movement of said latch plate means and associated movable switch contact, and a second position released from said detent means to facilitate movement of said latch plate means and snap-action movement of said movable switch contact between its said spaced and contacting positions relative to the other of said switch contacts.

2. The combination as defined in claim 1 wherein said detent means comprises a plurality of recesses formed in said latch plate means, said latch lever means being cooperative with a first one of said recesses to prevent movement of said latch plate means and said movable switch contact upon movement of said arming handle in a first direction whereafter release of said latch lever means from said first recess effects snap-action movement of said movable contact to a switched position, said latch plate means having a second recess cooperable with said latch lever means to retain said movable contact in said switched position and prevent movement thereof to a different switch position until said latch lever means is released from said second recess.

3. The combination as defined in claim 2 including means biasing said latch lever means into engagement with said latch plate recesses.

4. The combination as defined in claim 3 including solenoid means mounted on said casing and operatively associated with said latch lever means in a manner to facilitate control of said latch lever means remotely from said switch casing.

5. The combination as defined in claim 1 wherein said latch plate means includes a planar latch plate internally of said casing and having a plurality of recesses formed in its outer peripheral edge, said latch lever means including a latch roller disposed within said casing for engagement with said recesses so as to prevent movement of said latch plate when in cooperative relation with one of said recesses, said latch lever means further including a control handle operatively associated with said latch roller and movable from a position remote from said casing to effect release of said latch roller from said latch plate so as to facilitate snap-action movement of said movable switch contact between its said spaced and contacting positions relative to said other of said switch contacts.

6. The combination as defined in claim 1 wherein said actuating means includes a rotatable contact support arm having at least one movable switch contact supported thereon, a reaction plate secured to said support arm in normal relation thereto, torque plate means disposed parallel to said reaction plate and rotatable about an axis substantially coincident with the pivot axis of said contact support arm, arming springs operatively associated with said torque plate means and said reaction plate and armable upon rotation of said torque plate means relative to said reaction plate, and release means preventing rotation of said reaction plate until said arming springs have been charged a predetermined amount to create stored energy, said latch plate means being affixed to said contact support arm and having at least one recess detent in its peripheral edge, said latch lever means including an operating lever supported by said switch casing and having a latch roller engageable with said recess detent, means biasing said latch roller into engagement with said latch plate means so as to prevent rotation of said contact support arm upon arming said arming springs and release by said release means, said operating lever being remotely operable to release said latch roller from said latch plate means whereby to facilitate snap-action transfer of said movable switch contact between its said spaced and contacting positions relative to said other of said switch contacts during making or breaking of electrical contact therewith.

7. The combination as defined in claim 1 including means operatively associated with said latch lever means and facilitating remote control of said latch lever means between its said first and second positions to control movement of said latch plate means.

* * * * *